US006578594B1

(12) United States Patent
Bowen et al.

(10) Patent No.: US 6,578,594 B1
(45) Date of Patent: Jun. 17, 2003

(54) MOBILE REHABILITATIVE WALKER

(75) Inventors: Bruce G. Bowen, Burley, ID (US); Jack Hunsaker, Burley, ID (US); David Edgar, Burley, ID (US); R. Dean Edgar, Burley, ID (US)

(73) Assignee: Wade Hawkes, Paul, ID (US)

( * ) Notice: Subject to any disclaimer, the term of this patent is extended or adjusted under 35 U.S.C. 154(b) by 0 days.

(21) Appl. No.: 09/378,388

(22) Filed: Aug. 20, 1999

(51) Int. Cl.[7] ..... A61H 3/00
(52) U.S. Cl. ..... 135/67; 297/5; 482/69
(58) Field of Search ..... 135/67; 297/5; 482/69

(56) References Cited

U.S. PATENT DOCUMENTS

| | | | | |
|---|---|---|---|---|
| 1,611,807 A | * | 12/1926 | Bergh | 482/69 |
| 2,719,568 A | * | 10/1955 | Webb | 482/69 X |
| 2,792,052 A | | 5/1957 | Johannesen | |
| 3,195,550 A | | 7/1965 | Ingalls et al. | |
| 3,778,052 A | | 12/1973 | Andow et al. | |
| 4,188,966 A | | 2/1980 | Palmer et al. | |
| 4,941,497 A | | 7/1990 | Prather et al. | |
| 5,156,176 A | | 10/1992 | Doorenbos | |
| 5,224,721 A | | 7/1993 | Santmann | |
| 5,255,697 A | | 10/1993 | Grauer | |
| 5,275,426 A | | 1/1994 | Tankersley | |
| 5,569,129 A | | 10/1996 | Seif-Naraghi et al. | |
| 5,603,677 A | | 2/1997 | Sollo | |
| 5,732,964 A | | 3/1998 | Durham et al. | |
| 6,139,475 A | * | 10/2000 | Bessler et al. | 482/69 X |

* cited by examiner

*Primary Examiner*—Anthony D. Barfield
(74) *Attorney, Agent, or Firm*—Thorpe North & Western

(57) ABSTRACT

A mobile rehabilitative walker is configured for use outdoors on an irregular and rough support surface. A support frame is configured for supporting a person in an upright position and includes a plurality of frame members defining an open rear end, and an interior space accessible through the open rear end, being sized for receiving a wheelchair through the open rear end and into the interior space. A plurality of wheels are rotatably coupled to the support frame and are configured for multidirectional movement on the irregular and rough support surface. The wheels have a diameter sized to reduce friction between the wheels and the support surface and sized to easily roll over the irregular and rough surface. A pair of adjustable hand grips extend towards the interior space, such that the user is stabilized within the interior space of the frame by grasping the hand grips. A support harness is vertically suspended from the support frame to support the user, and is configured for securing about the user's body. At least one mechanism is attached to the upper rail directly over the interior space. At least one suspension strap is coupled to the ratchet mechanisms and releasably coupled to the support harness.

11 Claims, 6 Drawing Sheets

MOBILE REHABILITATIVE WALKER

BACKGROUND OF THE INVENTION

1. The Field of the Invention

The present invention relates generally to a mobile rehabilitative walker for supporting and stabilizing a user, such as a quadriplegic or rehabilitation patient, in an upright position for general mobility and/or rehabilitation treatment. More particularly, the present invention relates to a mobile rehabilitative walker with large wheels and a wide base to allow the user mobility on irregular surfaces, such as would be found outdoors; provides adjustable hand grips for the user to grasp; and facilitates transition of the user from an initial position, such as sitting in a wheelchair, to the upright position supporting a portion of the user's weight.

2. The Background Art

It is often necessary or desirable for individuals with disabilities or injuries to be oriented in an upright or standing orientation for purposes of exercise and/or variety. For example, persons with a leg injury may need to stand and walk to exercise the injury as part of a rehabilitation procedure. As another example, elderly persons or quadriplegic and paraplegic persons must exercise and move their limbs. Such exercise and movement is typically required in fields such as rehabilitation, sports medicine, care centers, etc.

During such rehabilitative procedures and other exercises, it is generally preferable that the individual be "unweighed", or that the amount of the user's body weight contacting the ground be reduced. For example, it is typically recommended that the individual be unweighed 20%–40% of his body weight in order to reduce stress. On the other hand, excessive unweighing, for example 80%, may render the exercise useless. The amount of the user's weight contacting the ground is typically increased over time.

Various different types of devices have been developed to assist the disabled, injured, or elderly in upright movement and exercise. For example, it is common to find a pair of spaced apart parallel bars oriented horizontally at a level below the arms or shoulders of a user. The user stands and walks between the bars, utilizing the bars for stability and support. One disadvantage of such systems is that another person must be constantly available to "spot" the user. Such systems confine the direction and destination of the user to a constant straight path. In addition, such systems are confined to indoor facilities.

Other more mobile devices, such as walkers, have been developed to allow the user more variety in direction and destination and to allow the user to venture outdoors. One disadvantage of such devices is that they are commonly configured to be utilized with hard, flat, and smooth surfaces. In addition, such devices are often difficult to utilize with wheelchairs. For example, a user is required to get up out of a wheelchair, and then transition to the walker device. The user is subjected to increased risk of injury during the transition, and typically requires a great deal of assistance.

In addition to outdoor activity, a disabled, injured or elderly person may also be required to engage in indoor activity, such as using a treadmill. Another disadvantage with typical walkers is that they are not suitable for use on a treadmill.

Therefore, it would be advantageous to develop an apparatus to better orient a disabled, injured, or elderly user in an upright or standing orientation. It would also be advantageous to develop such an apparatus to facilitate the transition between an initial position, such as sitting in a wheelchair, to the upright, standing orientation. It would also be advantageous to develop such an apparatus for safely and securely maintaining the person in the upright, standing orientation. It would also be advantageous to develop such an apparatus more suitable for various different terrains, including irregular and/or rough surfaces. It would also be advantageous to develop such an apparatus that is more comfortable and supportive for the user. It would also be advantageous to develop such an apparatus for use with individuals of differing heights, and for use with a treadmill.

OBJECTS AND SUMMARY OF THE INVENTION

It is therefore an object of the present invention to provide an apparatus for orienting a disabled, injured, or elderly person in an upright or standing orientation.

It is another object of the present invention to provide such an apparatus for facilitating exercise and rehabilitation procedures.

It is another object of the present invention to provide such an apparatus for facilitating transition of the user from an initial position, such as seated in a wheelchair, to the upright orientation.

It is another object of the present invention to provide such an apparatus for use with various different terrains, including irregular and/or rough surfaces.

It is another object of the present invention to provide such an apparatus for safely and securely maintaining the person in the upright orientation.

It is another object of the present invention to provide such an apparatus that is more comfortable, stable, and supportive for the user.

It is another object of the present invention to provide an apparatus that may be used with a treadmill.

It is another object of the present invention to provide an apparatus for use with individuals of differing heights.

The above objects and others not specifically recited are realized in a specific illustrative embodiment of a mobile rehabilitative walker configured for use outdoors on an irregular and rough support surface. The walker has a support frame configured for supporting a person in an upright position. A plurality of frame members define opposite sides, a front between the sides, an open rear end opposite the front, and an interior space formed between the plurality of frame members accessible through the open rear end. Advantageously, the open rear end and interior space are sized for receiving a wheelchair through the open rear end and into the interior space. The interior space is further sized for receiving a user, and configured for allowing leg movement of the user.

A plurality of wheels are rotatably coupled to the support frame and elevate the support frame above the support surface. The wheels are configured for multidirectional movement on the irregular and rough support surface. Advantageously, the wheels have a diameter sized to reduce friction between the wheels and the support surface, and are sized to easily roll over the irregular and rough surface.

Advantageously, a pair of hand grips are adjustably attached to and extend from the support frame towards the interior space, and thus the user. The hand grips are configured for being grasped and held by the user's hands, such that the user is stabilized within the interior space of the frame by grasping the hand grips. In addition, the hand grips advantageously are vertically and pivotally adjustable to selectively move vertically along the length of the frame to match the height of the user, and to pivot towards and away from the interior space, and thus the user.

A support harness is vertically suspended from the support frame to support the user, and is configured for securing about the user's body, such that the support harness, and thus the user, is suspended in the open interior of the frame. The support harness is suspended from an upper member which preferably is vertically adjustable with respect to the support frame such that the apparatus can accommodate individuals of differing heights and such that the apparatus can be configured for use with a treadmill.

Advantageously, at least one ratchet mechanism is attached to the frame directly over the interior space. The ratchet mechanism has a lever arm for converting a relatively small amount of force into a relatively large amount of force for lifting a portion of the user's weight. At least one suspension strap is coupled to the ratchet mechanism and releasably coupled to the support harness.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
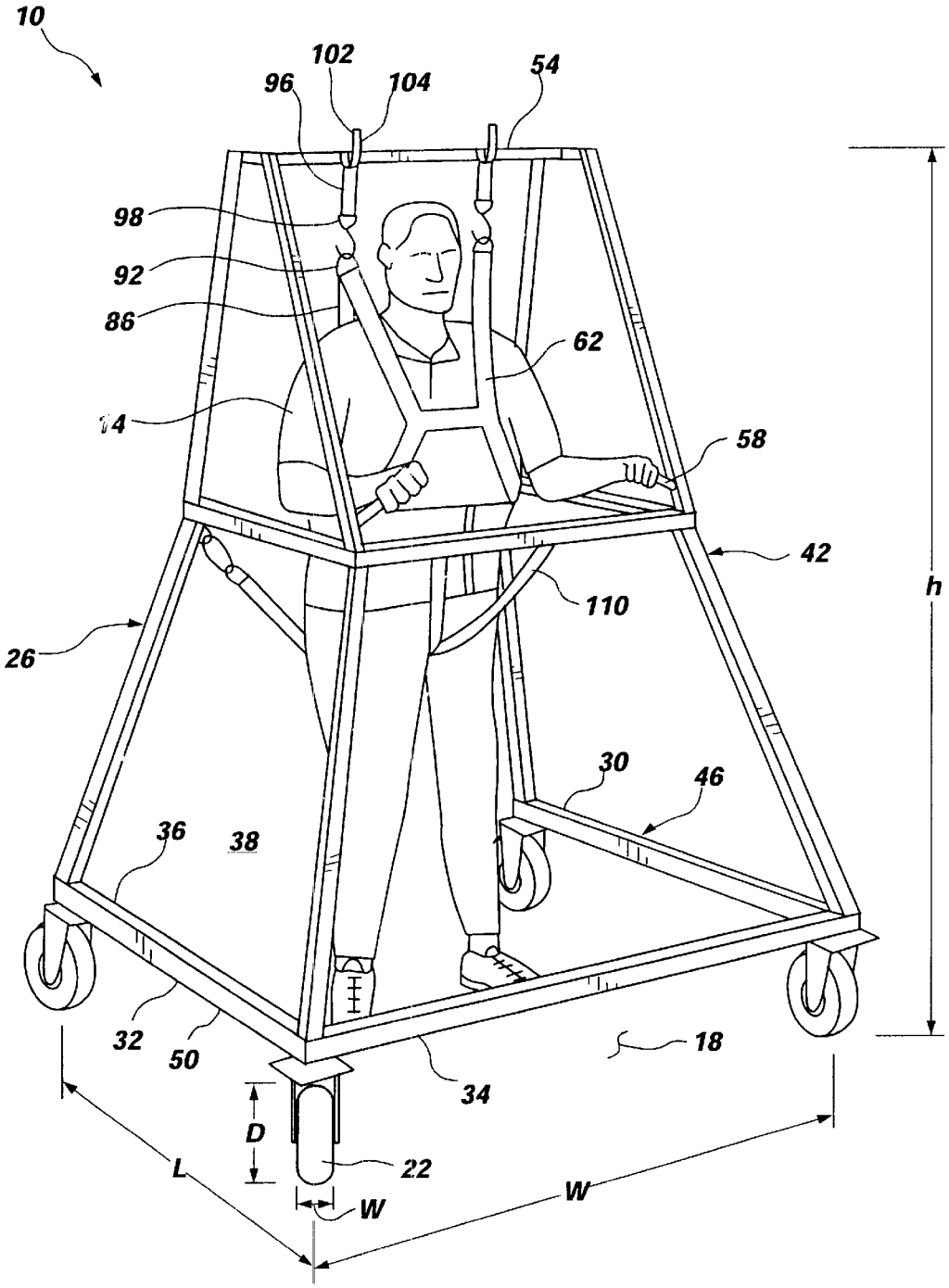
FIG. 1 is a perspective view of a preferred embodiment of a mobile rehabilitative walker of the present invention being used by a person.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
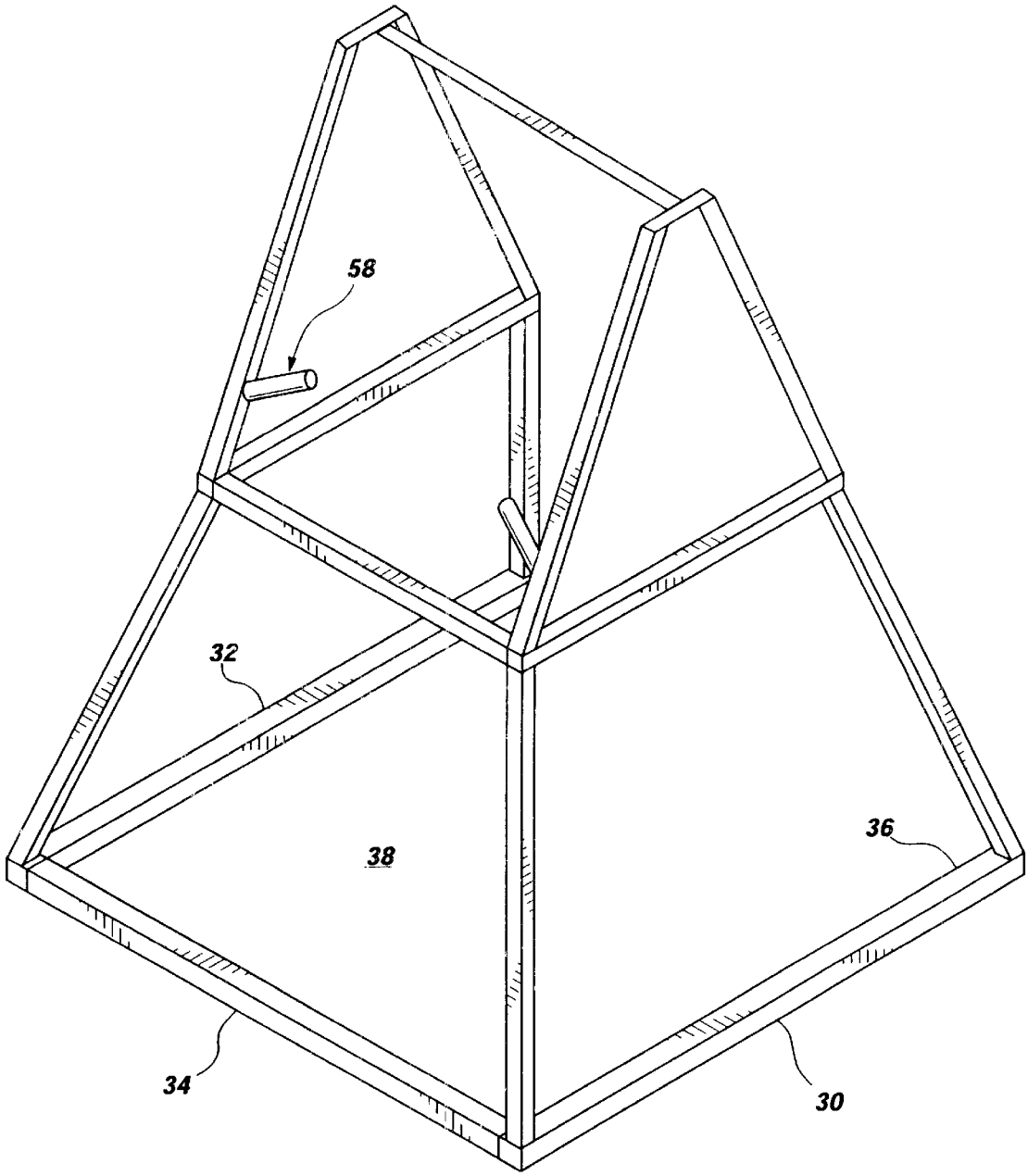
FIG. 2 is a perspective view of a preferred embodiment of a support frame of the present invention.

As illustrated in FIGS. 1 and 2, a mobile rehabilitative walker, indicated generally at 10, in accordance with the present invention is shown for orienting and supporting a person 14 in an upright orientation. As indicated above, the person may be disabled, such as a quadriplegic or paraplegic person or user; have an injury, such as a pulled tendon in the leg; may be elderly; or have any other condition which requires mobile upright support. Also as indicated above, the mobile rehabilitative walker 10 of the present invention may be used in various different circumstances or settings, including, for example, rehabilitation, sports medicine, care centers, etc. Thus, the walker 10 of the present invention is configured to orient and maintain the user 14 in an upright, vertical, or standing orientation, such that the user is moved to a different orientation than sitting or lying, and such that the user may participate in an exercise or rehabilitative procedure, such as walking.

The mobile rehabilitative walker 10 of the present invention advantageously allows the user 14 to engage in such activities in an outdoor environment, and over various different terrains. Thus, the user 14 is not constrained to indoor facilities or areas with hard, flat, smooth surfaces. The walker 10 is configured for use on irregular and rough support surfaces 18. The support surface 18 may be uneven, sloped, or have indentations or cavities. The support surface 18 may be covered with varying quantities of objects such as rocks, gravel, or sticks. In addition, the support surface 18 may be relatively softer, such as grass, dirt, etc. Such surface conditions are typically encountered in numerous outdoor activities, such as walking down the street, attending a park or ball game, etc.

The mobile rehabilitative walker 10 advantageously has a plurality of wheels 22 having a diameter D sized for movement on the irregular and rough support surface 18, and sized to reduce friction between the wheels 22 and the irregular and rough surface 18. The diameter D of the wheels 22 is preferably approximately at least six inches, and most preferably approximately at least eight inches. In addition, the wheels preferably have a width w of approximately between one and three inches and most preferably approximately two inches. Thus, the wheels 22 have a substantial diameter and substantial width, which create a substantial surface area configured for spanning across indentations in the support surface 18, and easily rolling over other objects and portions of the irregular and rough support surface 18. The large wheels 22 of the present invention reduce friction between the wheels 22 and the surface 18, and are less likely to become lodged in an indentation of the surface 18. In addition, the walker 10 is less likely to tip, as discussed more fully below. In addition, the wheels 22 are preferably inflatable rubber tires. Thus, the wheels are more flexible than the typical rigid plastic or rigid rubber wheels of prior art walkers, and better capable of deforming over protrusions in the surface 18. In addition, the wheels are preferably pivotal or capable of multi-directional movement. These rough and irregular surface conditions would typically prevent a conventional walker from performing its intended function because such indentations or objects would lodge between the surface and wheels of conventional walkers, preventing them from movement. In addition, such conventional walkers are typically narrow and prone to toppling.

The wheels 22 are rotatably coupled to a support frame, indicated generally at 26, and elevate the support frame above the support surface 18. As indicated above, the wheels are pivotally coupled to the support frame 26 so that the frame 26 is capable of multi-directional movement. The wheels 22 may be coupled to the frame 26 in a caster-like fashion so that the wheels pivot or swivel to accommodate changes in direction.

The support frame 26 is configured for supporting the person 14 in an upright position or orientation as shown. A plurality of frame members make up the frame 26 and define opposite left and right sides 30 and 32, a front 34 between the sides, and an open rear end 36 opposite the front end 34. In addition, the frame members define an interior space 38 formed between the plurality of frame members which is accessible through the open rear end 36. The frame members, the open rear end 36, and the interior space 38 are preferably sized for receiving a wheelchair through the open rear end 36 and into the interior space 38. The frame 26 and open rear end 36 preferably have a width W between approximately 48 to 52 inches. Thus, the open rear end 36 and interior space 38 are sized large enough that a wheelchair may be wheeled directly into the interior space 38, or so that the frame 26 may be moved over a wheelchair, positioning the user 14 directly in the interior space 38. Therefore, the transportation or transition of the user from an initial position, such as seated in the wheelchair, to the walker is advantageously eliminated. The frame members and interior space 38 are further sized and configured for allowing leg movement of the user 14 when positioned in the interior space. Therefore, the user 14 may engage in exercise or rehabilitative procedures such as walking or extending the legs forward, backward, and to the sides.

The apparatus 10 advantageously may be used with a treadmill. The open rear end 36 and the interior space 38 are preferably sized for receiving a treadmill through the open rear end and into the interior space 38. Rather than orienting the user facing forward as shown in FIG. 1, the user may be positioned and oriented in the frame 26 to face rearwardly. The apparatus 10 may then be positioned over a treadmill with the treadmill extending though the open rear end and into the interior space. The apparatus 10 advantageously continues to provide support and stability to the user with the frame extending on either side of the treadmill.

The support frame 26 comprises, or the plurality of frame members include, a plurality of upwardly extending columns, indicated generally at 42. The columns 42 are sized to extend above the user's head. As shown, the columns 42 may extend inwardly towards the interior space 38 as they extend upwardly. The columns 42 preferably include a pair of front columns and a pair of rear columns so that the frame 26 is supported from all sides.

A plurality of horizontal rails are attached to and extend between the columns 42, thus coupling the columns 42 together. Lower rails, indicated generally at 46, are attached to lower ends of the columns 42 and form a base 50 of the support frame 26. The lower rails 46 preferably form a base 50 with a horizontally oriented, block U-shaped configuration. Thus, the sides 30 and 32 and front 34 are enclosed to form a stable and rigid frame 26, while providing an open rear end 36 for accessibility. The wheels 22 preferably include four wheels, one disposed at each corner of the block U-shape configuration of the base 50 to provide adequate stability.

The base 50 of the support frame 26 is preferably relatively large or wide. As indicated above, the frame 26 has a width W sized to receive a wheelchair into the interior space 38. The sides 30 and 32 of the frame 26 also have a length L similar in size to the width W of the front 34 and rear 36. The substantial size of the base 50 helps maintain the stability of the frame 26 by keeping the combined center of gravity of the user 14 and the frame 26 as far from an edge or side 30, 32, 34, 36 of the frame 26 as possible.

The large wheels 22 and large base 50 combine to form a walker 10 with improved stability and improved capabilities for traveling on regular and rough support surfaces 18, and thus creating an "all terrain" type walker 10 for use outdoors. The large wheels 22 are less likely to get caught in indentations in the surface 18 or become lodged against objects on the surface 18, and thus less likely to abruptly stop when encountering an obstacle. In addition, the large base 50 of the frame 26 provides greater stability and is less likely to violently tip as the wheels 22 encounter obstacles. In addition, the large base 50 of the frame 26 is more stable as the wheels 22 travel over softer and irregular surfaces, such as dirt and grass. Therefore, the wide base 50 and large wheels 22 of the walker 10 of the present invention combine to provide a significant improvement over prior art walkers, which typically have small hard wheels and narrow bases which are unsuitable for outdoor use on irregular and rough surfaces.

An upper rail 54 is attached to and extends between upper ends of the columns 42 at a height h above the user's head and positioned directly over the interior space 38 of the frame 26. As discussed more fully below, the user 14 is suspended from the upper rail 54. Thus, positioning the upper rail 54 directly over the interior space 38, or over a center of the interior space, positions the center of gravity of the user 14 in the center of the frame 26 and thus at an equal distance from all sides 30, 32, 34 and 46.

A pair of hand grips 58 are advantageously attached to the frame 26 and extend from the columns 42 towards the interior space 38 proximal to the user 14. Thus, the hand grips 58 are configured for being grasped and held by the user's hand. The user 14 may grasp the hand grips 58 to stabilize himself or herself within the interior space 38. As shown, the hand grips 58 preferably extend at an angle upwardly from the columns 42 to provide a grip oriented with respect to the natural orientation of the user's hand.

In addition, the hand grips 58 preferably are adjustably attached to the columns 42. Thus, the hand grips 58 may be vertically adjusted along the lengths of the columns 42 so that they can be selectively positioned at a height suited for the particular user 14. In addition, the grips may be pivoted towards and away from the interior space 38, and thus the user 14, to suit the user's preference. Because the columns 42 extend inwardly towards the interior space 38 as they extend upwardly, the hand grips 58 are advantageously positioned more proximal to the user 14.

A support harness 62 is vertically suspended from the upper rail of the support frame 26 such that it is suspended within the interior space 38. The support harness 62 supports the user 14 and transfers a portion of the user's weight to the frame 26. Thus, the harness 62 prevents the user 14 from falling and facilitates movement of the user 14 by removing some of the user's weight from his or her legs.

Figure 3:
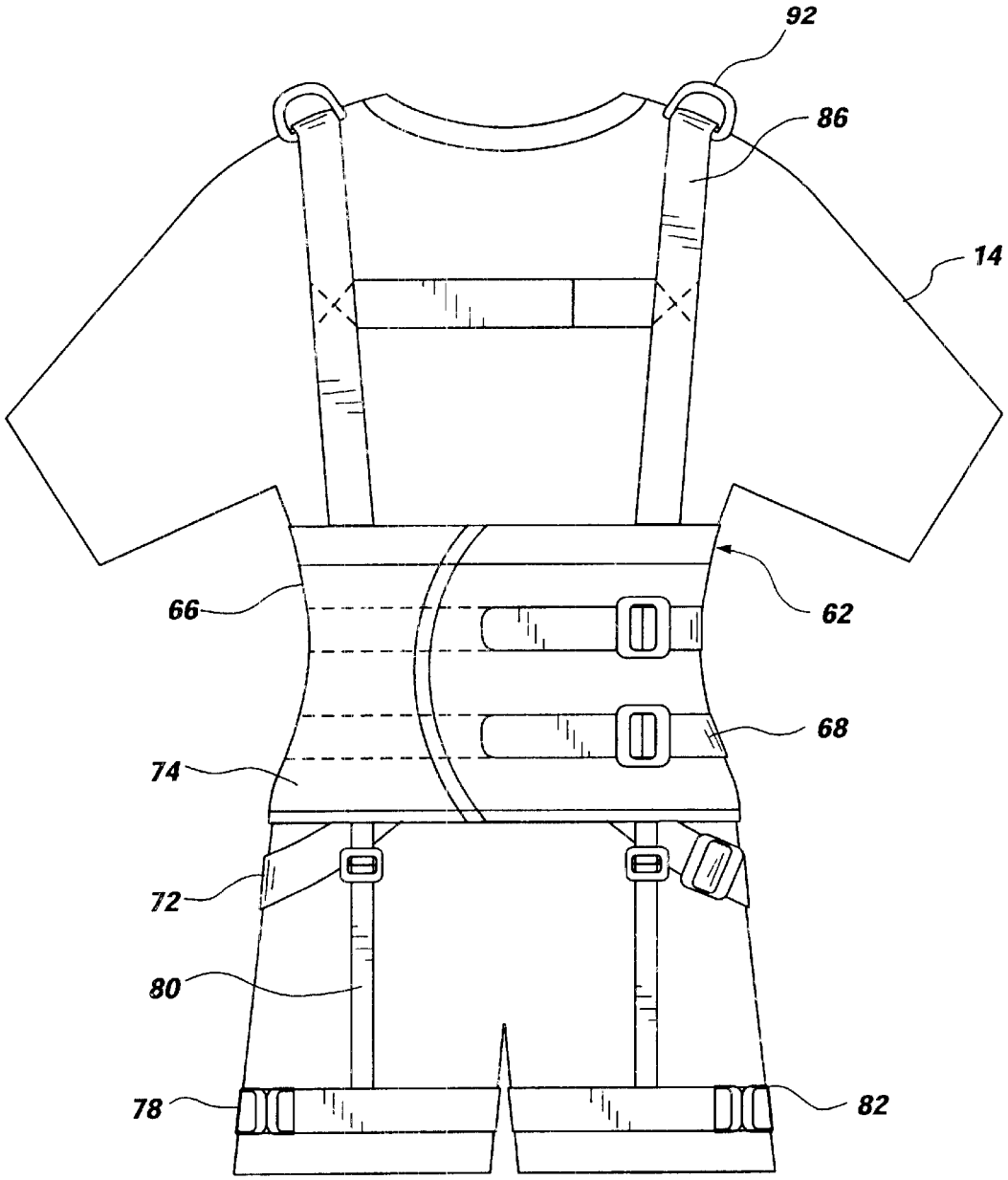
FIG. 3 is a front side view of a preferred embodiment of a support harness of the present invention.
Figure 4:
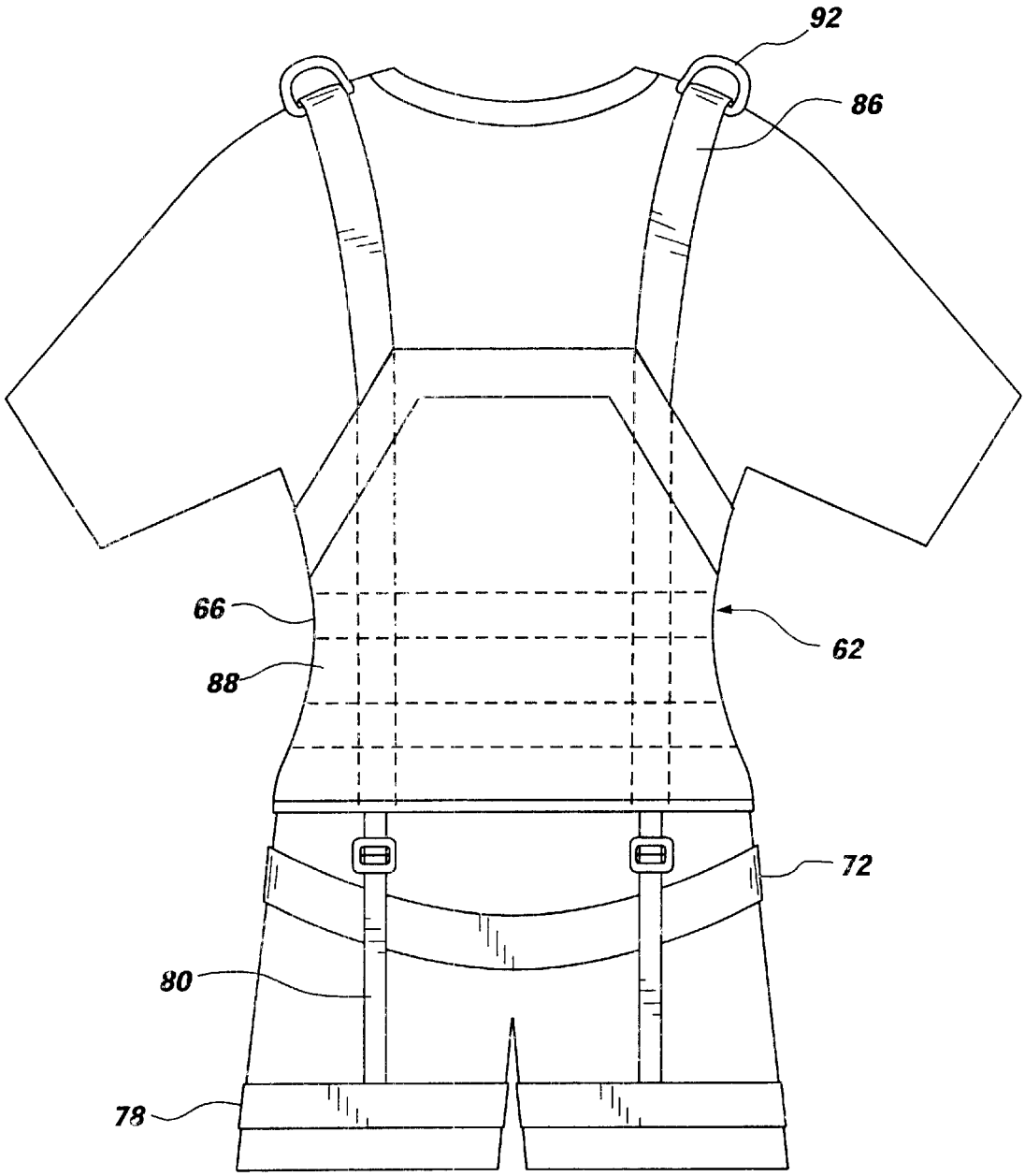
FIG. 4 is a back side view of a preferred embodiment of the support harness of the present invention.

Referring to FIGS. 3 and 4, the harness 62 is configured for removable attachment to the torso of the user 14. A mid portion 66 of the support harness 62 is wrapped around the user's waist and hips and secured by straps and buckles 68. A fanny strap 72 has ends attached to the front 74 of the mid portion 66 and forming a loop configured to extend around the buttocks of the user 14, to provide a seat like support. A pair of thigh braces are attached to and suspended from a mid portion 66 by straps 80. The thigh braces 78 form loops for wrapping around the thighs or upper legs of the user 14, and are adjustable with straps and buckles 82. A pair of shoulder straps 86 have ends attached to the front and back 74 and 88 of the mid portion 66 and forming loops for extending over the user's shoulders. Rings 92 are attached to the shoulder straps 86 proximal to the user's shoulders.

Referring again to FIG. 1, a pair of suspension straps 96 are coupled to and between the upper rail 54 and the support harness 62 for suspending the support harness. The suspension straps 96 preferably include hooks 98 for engaging the rings 92 on the shoulder straps 86.

A pair of ratchet mechanisms 102 advantageously are operatively coupled to the suspension straps 96. The ratchet mechanisms 102 take up, or draw in, a portion of the suspension straps 96, thus lifting a portion of the user's weight. The ratchet mechanisms 102 advantageously facilitate the transition of the user 14 from an initial position, such as seated in a wheelchair, to the upright orientation. For example, the user 14 seated in a wheelchair may be positioned within the interior space 38 of the frame 26. The hooks 98 of the suspension straps 96 are then coupled to the rings 92 of the support harness 62. Levers 104 of the ratchet mechanism 102 may be operated to convert the large degree of movement of the lever 104 under a small amount of force, to a small amount of movement of the suspension straps 96 under a great deal of force. Thus, the user 14 is slowly lifted to an upright position by operating the ratchet mechanisms 102. The ratchet mechanisms 102 may be of any well known type, preferably attached to the upper rail 54 as shown.

As the levers 104 are operated, the ratchet mechanisms 102 incrementally take up discrete lengths of the straps 96. The amount of the straps 96 which is drawn into the ratchet mechanisms 102 is directly related to the amount or percentage of the user's weight which is supported by the apparatus 10. As indicated above, it is typically desirable to "unweigh" the user by reducing the amount of the user's body weight on the ground. The percentage of the user's body weight which is unweighed is related to the user's weight and the amount or distance of the straps 96 taken up by the ratchet mechanisms. After the straps 96 are snug, further operation of the levers 104 causes the ratchet mechanisms to incrementally take up discrete lengths of the straps 96, and discrete percentages of the user's body weight. For example, operating the levers 104 to take up a quarter-inch of the straps may result in unweighing the user by 5%. Thus, if it is necessary to unweigh the user by 20%, the levers can be operated to draw in an inch of the straps 96.

Figure 5:
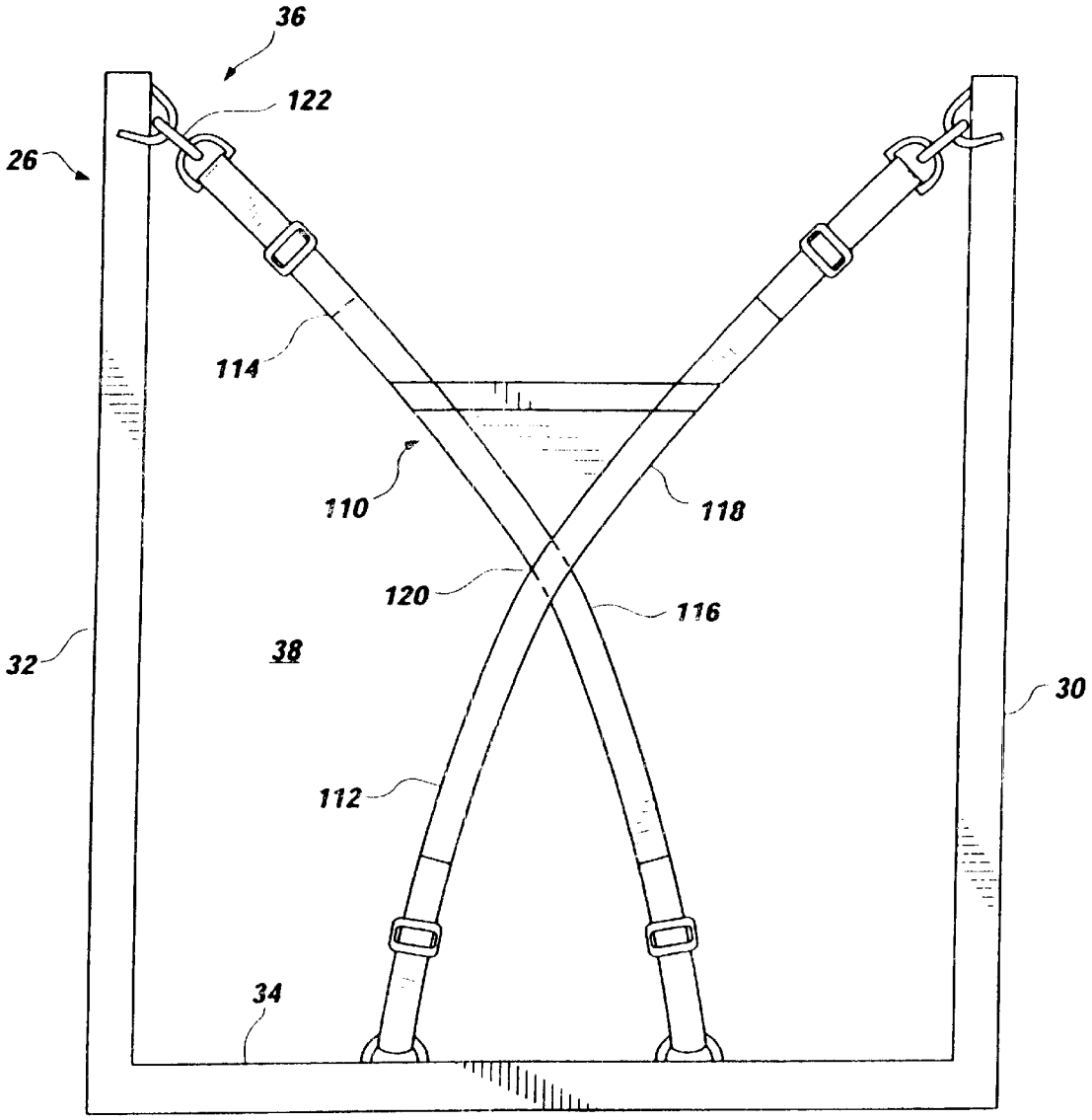
FIG. 5 is a partial top view of a preferred embodiment of the mobile reabilitative walker of the present invention.

Referring to FIG. 5, the walker 10 may be provided with a safety seat 110 suspended from the frame 26 and configured for passing between the legs of the user 14 as shown in FIG. 1. The seat 110 has front straps 112 coupled to the front 34 of the frame 26 and rear straps 114 coupled to the rear 36 of the frame 26. Thus, the rear straps 114 may be selectively coupled and uncoupled to the rear 36 of the frame 26 to secure and remove the user from the frame. The seat 110 may comprise first and second straps 116 and 118 coupled together in an X-shaped configuration forming a narrow section 120 at a middle of the straps 116 and 118 and middle of the X-shaped configuration, configured for being positioned between the legs of the user 14. Rings or hooks 122 may be attached to the rear straps 114 for releasably securing the rear straps 114 to the frame 26. If the user 14 should fall, the safety seat 110 is advantageously positioned to prevent the user 14 from falling to the surface 18.

Figure 6:
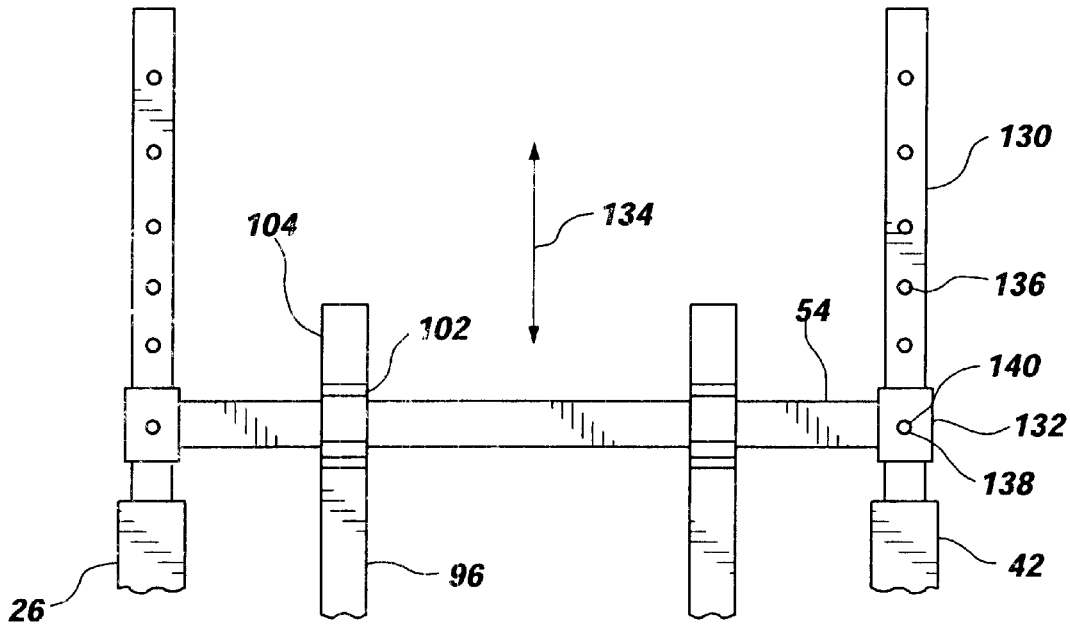
FIG. 6 is a partial front view of a preferred embodiment of the mobile rehabilitative walker of the present invention.

Referring now to FIG. 6, the upper rail 54 advantageously may be adjustably coupled to the upper ends of the columns 42. For example, a pair of vertical members 130 may extend vertically upwardly from the upper end of the support frame 26, or upper ends of the columns 42. Each end of the upper rail 54 has a collar 132 for engaging one of the vertical members 130. The collars 132 define a hollow interior or passage through which the vertical members 130 pass. Thus, the vertical members 130 are movably received within the collars 132 such that the collars 132 and the upper rail 54 may move up and down as indicated by arrow 134, along the length of the vertical members 130. A plurality of holes or apertures 136 are formed in the vertical members 130 at incrementally spaced apart distances. Each collar 132 also has a hole 138 formed therein. Pins 140 are removably received through the holes 138 in the collars 132 and one of the plurality of holes 136 and the vertical members 130 to fixedly secure the upper rail 54 at a predetermined position with respect to the vertical members 130, and thus at a predetermined height from the ground.

The adjustable upper rail 54 advantageously allows the upper rail to be coupled to the frame 26 at various heights to accommodate the height of the user. Thus, for collar users, the upper rail 54 can be disposed at a higher position on the frame 26. In addition, the upper rail 54 may be raised to a higher position when the apparatus 10 is used with a treadmill. As discussed above, the apparatus 10 may be used with a treadmill by positioning the apparatus 10 over the treadmill with the treadmill extending through the open rear end 36 and into the interior space 38. Because the treadmill has a height, for example, six to twelve inches, the user is elevated an equal distance with respect to the frame 26. Thus, the upper rail 54 can be adjusted upwardly on the frame 26 to accommodate the elevated position of the user.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A mobile rehabilitative walker comprising:

a plurality of wheels configured for multidirectional movement on a support surface;

a frame coupled to the plurality of wheels including a plurality of frame members defining opposite sides, a front between the sides, an open rear end opposite the front, and an interior space formed between the plurality of frame members accessible through the open rear end and sized for receiving a user and configured for allowing leg movement of the user, the plurality of frame members including a plurality of upwardly extending columns extending to a height above the user, a plurality of horizontal rails attached to and extending between the columns including lower rails attached to lower ends of the columns providing a base for the columns, and an upper rail attached to upper ends of the columns and located directly over the interior space of the frame;

a pair of hand grips directly attached to and extending inwardly from opposite columns into the interior space, and thus the user, and configured for being grasped and held by the user's hands, such that the user is stabilized within the interior space of the frame by grasping the hand grips;

a harness vertically suspended from the upper rail of the frame into the interior space, the harness configured for removable attachment to an upper torso of the user; and a pair of vertical suspension members having first ends coupled to the upper rail of the frame directly above the interior space, and opposite second ends coupled to the harness.

2. The mobile rehabilitative walker of claim 1, wherein the open rear end and interior space are sized for receiving a wheelchair through the open rear end and into the interior space; and wherein the wheels are configured for multidirectional movement on the irregular and rough support surface and having a diameter sized to reduce friction between the wheels and the support surface and sized to easily roll over the irregular and rough surface.

3. The mobile rehabilitative walker of claim 1, further comprising:

at least one suspension strap coupled to and between the upper rail and the support harness for suspending the support harness from the frame; and a ratchet mechanism operatively coupled to the at least one suspension strap for taking up a portion of the strap, and thus lifting a portion of the user's weight.

4. The mobile rehabilitative walker of claim 1, wherein the upper rail is adjustably coupled to the upper ends of the columns and is vertically adjustable.

5. A mobile rehabilitative walker comprising:

a support frame configured for moveable displacement on a support surface and defining an open interior in between the frame for receiving a user, the support frame including a generally U-shaped base member oriented horizontally proximal to the support surface, the base member having a front member, two side members coupled to opposite ends of the front member, and an open rear opposite the front member, the base member being sized to provide space for the user to move his or her legs within the U-shaped base member and provide stability to the support frame, a plurality of support columns having lower ends coupled to the base member, the support members extending upwardly from the base member to upper ends, the support members including two front members coupled to the front of the base member and two rear members coupled to the rear of the base member, an upper rail attached to the upper ends of the support members and located directly over the open interior of the frame, a plurality of wheels coupled to the base member and configured for moveable displacement on the support surface;

a support harness vertically suspended from the upper rail of the support frame to support a person and configured for securing about the user's body, such that the support harness, and thus the user, is suspended in the open interior of the frame;

first and second suspension straps each coupled to and between the upper member and the support harness;

first and second ratchet mechanisms operatively coupled to the respective first and second suspension straps and each attached to the upper member, each having a lever arm for converting a relatively small amount of force into a relatively large amount of force for lifting a portion of the user's weight; and the upper rail being adjustably coupled to the upper ends of the columns and being vertically adjustable.

6. The mobile rehabilitative walker of claim 5, wherein the harness comprises:

a vest portion configured for attaching to a portion of the user's torso, and a pair of suspender straps coupled to and extending between front and back portions of the vest and configured for extending over the person's shoulders.

7. The mobile rehabilitative walker of claim 5, wherein the open rear end and interior space are sized for receiving a wheelchair through the open rear end and into the interior space; and wherein the wheels are configured for multidirectional movement on the irregular and rough support surface and having a diameter sized to reduce friction between the wheels and the support surface and sized to easily roll over the irregular and rough surface.

8. The mobile rehabilitative walker of claim 5, further comprising:

a pair of hand grips directly attached to and extending inwardly from opposite columns into the interior space, and thus the user, and configured for being grasped and held by the user's hands, such that the user is stabilized within the interior space of the frame by grasping the hand grips.

9. A mobile rehabilitative walker configured for use outdoors on an irregular and rough support surface, the walker comprising:

a support frame configured for supporting a person in an upright position and including a plurality of frame members defining opposite sides, a front between the sides, an open rear end opposite the front, and an interior space formed between the plurality of frame members accessible through the open rear end, the open rear end and interior space being sized for receiving a wheelchair through the open rear end and into the interior space, the interior space further being sized for receiving a user and configured for allowing leg movement of the user, the plurality of frame members including a plurality of upwardly extending columns extending to a height above the person, a plurality of horizontal rails attached to and extending between the columns including lower rails attached to lower ends of the columns providing a base for the columns, and an upper rail attached to upper ends of the columns and located directly over the interior space of the frame;

a plurality of wheels rotatably coupled to the support frame and elevating the support frame above the support surface, the wheels being configured for multidirectional movement on the irregular and rough support surface and having a diameter sized to reduce friction between the wheels and the support surface and sized to easily roll over the irregular and rough surface;

a pair of hand grips directly attached to and extending inwardly from opposite columns into the interior space, and thus the user, and configured for being grasped and held by the user's hands, such that the user is stabilized within the interior space of the frame by grasping the hand grips;

a support harness vertically suspended from the upper rail of the support frame to support a person and configured for securing about the user's body, such that the support harness, and thus the user, is suspended in the open interior of the frame;

at least one ratchet mechanism, attached to the upper rail directly over the interior space, having a lever arm for converting a relatively small amount of force into a relatively large amount of force for lifting a portion of the user's weight;

at least one suspension strap coupled to the ratchet mechanism and releasably coupled to the support harness; and a safety seat, separate from the support harness, suspended from the frame and positioned and configured for passing between the user's legs, the safety seat having a front strap coupled to and between the front of the frame and the seat, and a rear strap coupled to the seat and releasably coupled to the rear of the frame such that the second rear may be selectively coupled and uncoupled to the rear of the frame to secure and remove the user from the frame, respectively.

10. The mobile rehabilitative walker of claim 9, wherein the seat comprises first and second straps each having a middle section coupled together in an X-shaped configuration with a narrow section at the middle of the X-shaped configuration configured for being positioned between the legs of the user, the straps having front ends coupled to the front of the frame in a spaced apart relationship, and rear ends coupled to the rear of the frame in a spaced apart relationship.

11. The mobile rehabilitative walker of claim 9, wherein the upper rail is adjustably coupled to the upper ends of the columns and is vertically adjustable.

* * * * *